US006012717A

United States Patent [19]

Love

[11] Patent Number: 6,012,717

[45] Date of Patent: Jan. 11, 2000

[54] PLAYING CARD HOLDER

[76] Inventor: Samuel D. Love, 13510 Old Indian Head Rd., Brandywine, Md. 20613

[21] Appl. No.: 09/162,507

[22] Filed: Sep. 29, 1998

[51] Int. Cl.[7] ..... A63F 1/10

[52] U.S. Cl. ..... 273/148 A

[58] Field of Search ..... 273/148 A, 150, 273/239; 248/459, 460, 174; 40/124, 124.2

[56] References Cited

U.S. PATENT DOCUMENTS

| | | | |
|---|---|---|---|
| 805,895 | 11/1905 | Wedderburn | 273/150 |
| 1,410,959 | 3/1922 | Ritter | 273/150 |
| 2,150,850 | 3/1939 | Smith . | |
| 2,913,137 | 11/1959 | Alatorre . | |
| 3,069,168 | 12/1962 | Feldman et al. | 273/148 A X |
| 3,658,336 | 4/1972 | Knapp | 273/239 |
| 3,816,948 | 6/1974 | Mooney et al. . | |
| 4,312,393 | 1/1982 | Green | 40/124.2 X |
| 4,346,895 | 8/1982 | Brownlee . | |
| 4,651,872 | 3/1987 | Joyce . | |
| 5,029,797 | 7/1991 | Levorchick et al. . | |
| 5,412,886 | 5/1995 | Quinn | 40/124.2 X |
| 5,558,330 | 9/1996 | McCune . | |

*Primary Examiner*—Raleigh W. Chiu
*Attorney, Agent, or Firm*—Oliff & Berridge, PLC

[57] ABSTRACT

A card holder has two rigid panels that are flexibly connected to each other along edges thereof by a flexible hinge. Pockets are located on one side of each panel, for example, such that an opening of at least one pocket on each panel is directed toward the common edge. Preferably, the pockets on one panel face the pockets on the other panel when the card holder is in a closed position and face away from the pockets on the other panel when the card holder is in an open position. Preferably, the first and second rigid panels are attached to each other by only the flexible hinge, and include no additional supporting structure to maintain the card holder in the open position. Thus, the card holder is incapable of maintaining itself in the open position.

20 Claims, 4 Drawing Sheets

PLAYING CARD HOLDER

BACKGROUND OF THE INVENTION

1. Field of Invention

The present invention relates to an apparatus for holding and displaying cards such as playing cards.

2. Description of Related Art

In many games there are cards that are collected by a player and then used during the course of the game. It is often required that the player be able to see all of the cards in his possession. In certain games, such as board games, a player may also be required to perform other actions besides simply collecting, holding and using the cards. Thus, it is desirable to provide a playing card holder so that the player's hands are free to perform other actions.

U.S. Pat. No. 5,558,330 discloses a playing card organizer having a planar mat and a plurality of straps for holding cards against the mat. This device is intended to hold the cards for one player and is planar in use.

U.S. Pat. No. 4,651,872 discloses a foldable display for computer disks having three connected folding sections. One of the folding sections is used as a cover when the display is in the closed position and is used as a brace between the other two folding sections when the display is in an open position.

U.S. Pat. No. 2,913,137 discloses a game kit that can be set up in the form of an easel to hold and display game pieces. The two panels of the game kit are secured together in an erect position by a fastener.

Other card holding arrangements are shown in U.S. Pat. Nos. 2,150,850, 4,346,895 and 5,029,797.

For convenience of storage and transportation, it is preferable that a card holder be very thin when in the closed position. Some of the card holders or game holders known in the art have substantial thickness in the closed position due to the existence of some sort of brace or support used to hold the device in the open position. Additionally, the provision of a brace or other support structure increases the cost to manufacture the device.

SUMMARY OF THE INVENTION

A playing card holder according to one aspect of the invention eliminates the need for structure to hold the device in the open position. By doing so, the device can be extremely thin in the closed position.

In addition, by eliminating the need for structure to hold the device in the open position, the playing card holder is less costly to manufacture.

According to one embodiment of the invention, a playing card holder has two panels attached to each other by a hinge. The panels are rectangular and attached by a hinge along one side of each panel. In this embodiment, the device opens and closes about the hinge much like a book. Each panel includes a plurality of card holding pockets. The openings of the pockets on one panel can face the openings of the pockets on the other panel, whereby each panel is used by a different player to hold that player's cards.

In use, the playing card holder is simply opened to an A-frame position such that the card pockets formed on one side of each panel face outwards. Once in this position, the playing card holder may be placed inside the lid of the board game's box such that lower edges of the opened device come to rest against the inside corners of the box lid. In this position, the box lid prevents the device from collapsing and therefore maintains the A-frame position.

These and other features and advantages of this invention are described in, or are apparent from, the following detailed description of preferred embodiments.

BRIEF DESCRIPTION OF THE DRAWINGS

The invention will be described in relation to the following drawings in which like reference numerals refer to like elements, and wherein.

DETAILED DESCRIPTION OF PREFERRED EMBODIMENTS

An embodiment of the present invention is the card holder shown in FIGS. 1–4. The invention will be described using the card holder shown in FIGS. 1–4 as an example. However, the invention should not be interpreted as being limited to this example.

Figure 1:
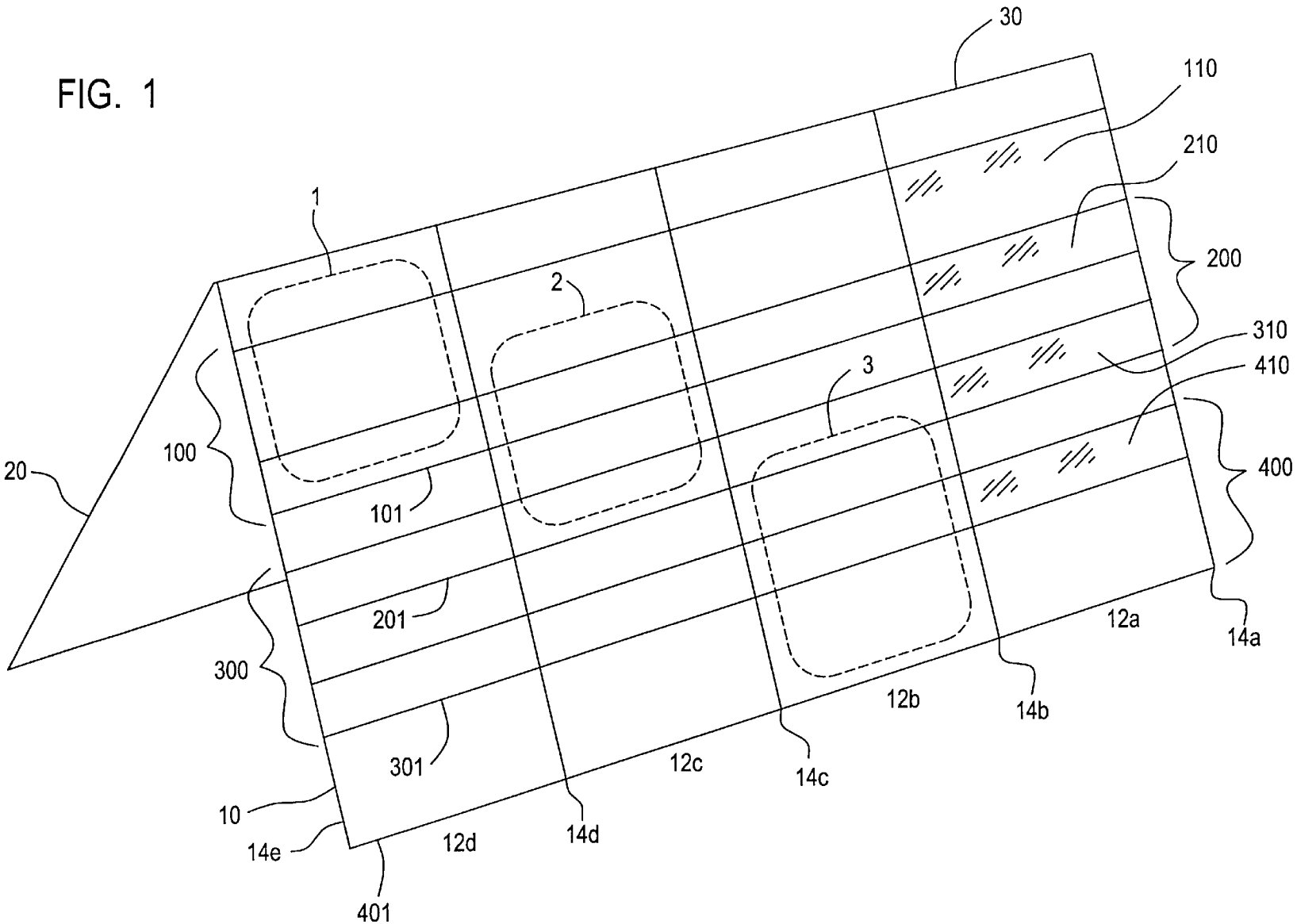
FIG. 1 is a perspective view of an embodiment of the invention in an open and upright position.

FIG. 1 shows a first panel 10 attached at one edge thereof to an edge of a second panel 20. The attaching point of the first panel 10 and the second panel 20 is a hinge 30. In the example shown in FIG. 1, first panel 10 and second panel 20 are rectangular panels.

Figure 2:
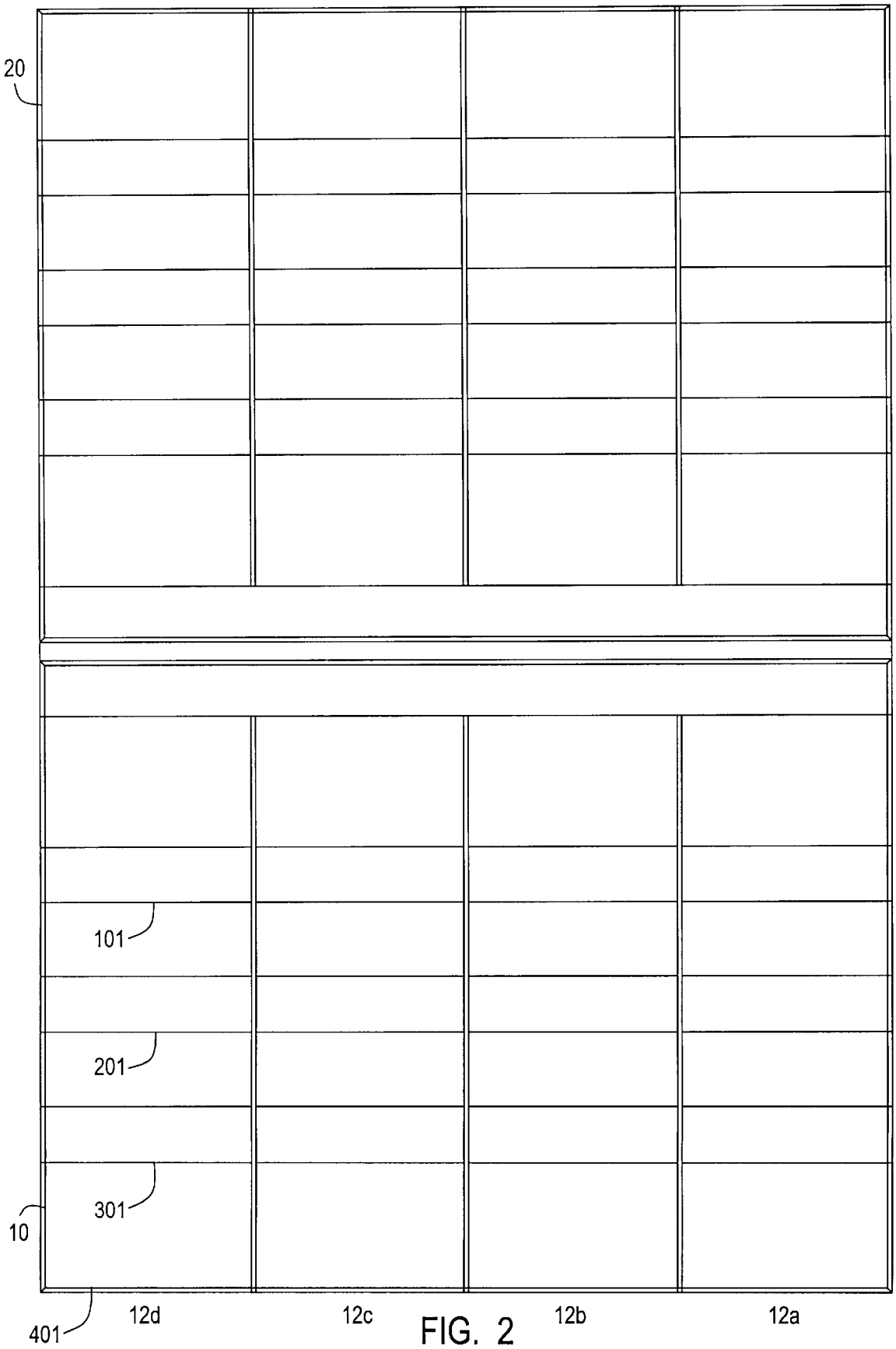
FIG. 2 is a top plan view of the card holder shown in FIG. 1 in an open and flat position.
Figure 3:
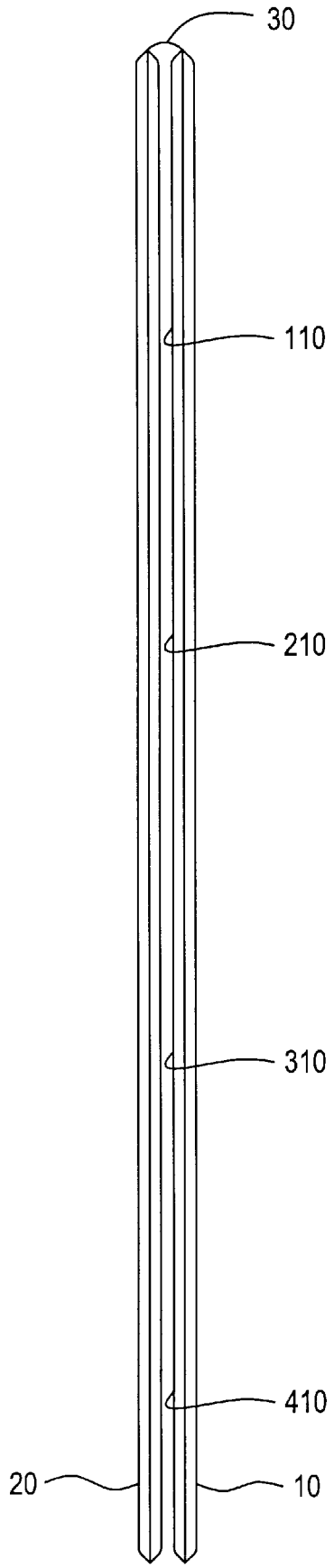
FIG. 3 is an end view of the card holder shown in FIGS. 1 and 2 in a closed position.

FIG. 2 is a top plan view of the card holder shown in FIG. 1. In FIG. 2 the card holder is laid flat such that first panel 10 and second panel 20 are coplanar. FIG. 3 shows the card holder in a closed position in which the first panel 10 and the second panel 20 occupy substantially parallel planes.

In this example, first panel 10 and second panel 20 are made of a flexible thermoplastic material such as, e.g., vinyl surrounding (i.e., encasing) a rigid material such as, e.g., cardboard or thin plastic. The rigid material does not exist in the area of hinge 30. Thus, the card holder is formed by encasing first and second rectangular pieces of rigid material with a thermoplastic material (much like some notebooks, although notebooks usually include a third panel between the first and second panels to form a ring support).

On one side of each of the first panel 10 and the second panel 20, pockets are formed to hold, for example, playing cards. Although in this example, only one side of each of the first panel 10 and the second panel 20 have pockets for holding the cards, an alternative embodiment of the invention includes pockets on both sides of one or both of the first panel 10 and the second panel 20.

The forming of the pockets in this example will be explained by reference to the side of first panel 10 shown in FIG. 1. In this example, horizontal strips 100, 200, 300, 400 of thin flexible (e.g., plastic) material are laid over the side of first panel 10 and thermally welded into place. Preferably, strips 100, 200, 300 and 400 are transparent so that the playing cards can be viewed therethrough. Initially, first horizontal strip 100 of the height shown in FIG. 1 and the entire width of the card holder is laid in place on first panel 10. Next, second horizontal strip 200 is similarly laid in place on first panel 10 such that an upper portion of second horizontal strip 200 overlaps a lower portion of the first horizontal strip 100. Next, third horizontal strip 300 is similarly laid in place such that an upper portion of horizontal strip 300 overlaps a lower portion of horizontal strip 200. Lastly, horizontal strip 400 is laid in place such that an upper portion of horizontal strip 400 overlaps a lower portion of horizontal strip 300. With the four horizontal strips in place, the assembly is subject to heat along vertical separations 14*a*–14*e* and horizontal separations 101, 201, 301, 401. The heat to which these separations are subjected is sufficient to cause the horizontal strips of thin flexible material to be welded to the first panel 10 along the horizontal and vertical separations.

The above described procedure forms, for example, a first pocket 110 with an open top along the upper edge of first horizontal strip 100 between vertical separations 14*a* and 14*b*, a closed bottom along horizontal separation 101 between vertical separations 14*a* and 14*b*, and two closed sides along vertical separations 14*a* and 14*b*. Second pocket 210, third pocket 310, and fourth pocket 410 are similarly formed as shown in FIG. 1. Further, each of the other columns 12*b*–12*d* have four pockets similar to pockets 110, 210, 310, 410 of column 12*a*. In this example, this procedure creates 16 pockets (four columns of four pockets each) on one side of first panel 10. A similar procedure performed on second panel 20 creates a similar 16 pockets on one side of second panel 20.

The above procedure for forming the pockets on one side of each of first panel 10 and second panel 20 is only an example of how the pockets can be formed. Many methods of forming pockets are known in the art and could alternatively be used. In addition, multiple card holders could be fabricated at one time by using long sections of panel material and long horizontal strips and then cutting the panel material and horizontal strips into individual card holders after the pockets have been formed.

First card 1, second card 2, and third card 3 are shown in dotted lines in FIG. 1 as exemplary positions of cards in pockets of the card holder.

Hinge 30 is simply formed by welding opposite sides of the thermoplastic covering material to each other between the rigid pieces that form the panels 10 and 20. By forming the hinge 30 as described above, the thickness of the card holder in the closed position shown in FIG. 3 is kept to a minimum. The small thickness in the closed position is a result of not needing additional structural elements of the card holder to support the card holder in the open and upright position shown in FIG. 1. Formation of the hinge 30 usually results in a structure by which the card holder more easily closes in one direction (as illustrated in FIG. 3). It is preferable to include indicia such as, for example, the name of the game and possibly game instructions on the outside surface(s) of the holder when in the closed position. In such case, the pockets preferably are located on the inside surfaces of the holder as shown in FIG. 3.

Figure 4:
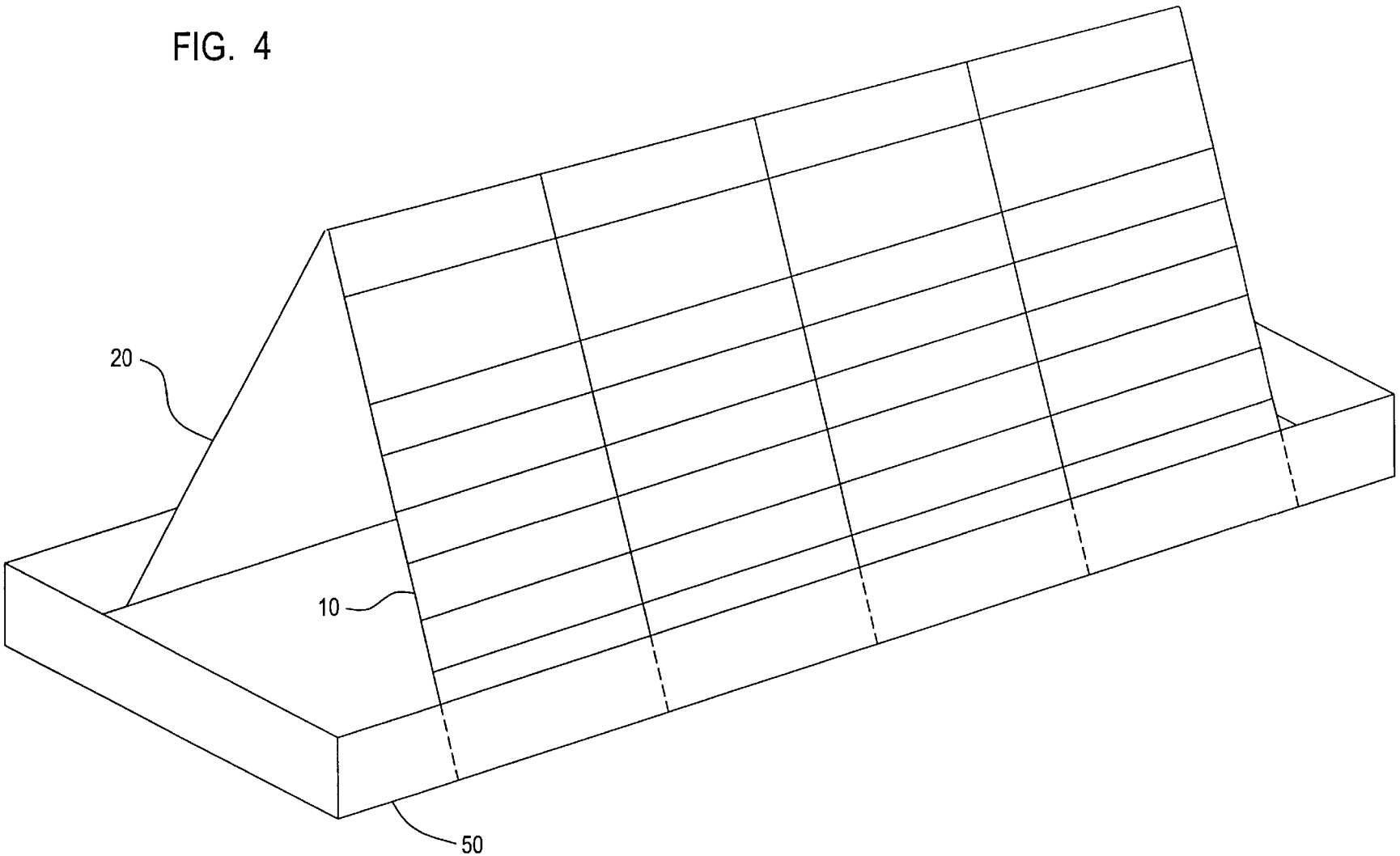
FIG. 4 is a perspective view of the card holder shown in FIGS. 1–3 in an open and upright position, supported by a box lid.

Because the hinge 30 is flexible and does not hold the card holder in the position shown in FIG. 1 (and in fact, as discussed above, tends to close in an opposite direction to that shown in FIG. 1), support external to the card holder itself is desirable to maintain this position. FIG. 4 shows an example of such external support provided by box top 50. When using the card holder with a board game or other game having a box, the card holder is simply placed inside the inverted box top such that the lower edges of first panel 10 and second panel 20 come in contact with the inside corners of the box top 50.

The openings of the pockets can extend in other directions, for example, to the side, instead of upwardly as illustrated in FIG. 1.

While the present invention has been described with reference to preferred embodiments thereof, it is to be understood that the invention is not limited to the disclosed embodiments or constructions. To the contrary, the invention is intended to cover various modifications and equivalent arrangements. In addition, while the various elements of the disclosed invention are shown in various combinations and configurations, which are exemplary, other combinations and configurations, including more, less or only a single element, are also within the spirit and scope of the invention.

What is claimed is:

1. A card holder comprising:

a first rigid panel having a first side, a second side and a first edge;

a second rigid panel having a first side, a second side and a first edge;

a flexible hinge connecting the first edge of the second rigid panel to the first edge of the first rigid panel such that the first side of the first rigid panel faces the first side of the second rigid panel when the card holder is in a closed position and the second side of the first rigid panel faces the second side of the second rigid panel when the card holder is in an open position;

a first plurality of pockets attached to the first side of the first rigid panel; and a second plurality of pockets attached to the first side of the second rigid panel;

the first and second rigid panels being attached to each other by only the flexible hinge, and including no additional supporting structure to maintain the card holder in the open position, the card holder being incapable of maintaining itself in the open position;

each pocket of the first plurality of pockets has an opening directed toward the first edge of the first rigid panel, and each pocket of the second plurality of pockets has an opening directed toward the first edge of the second rigid panel.

2. The card holder of claim 1 in combination with a box lid having at least two side panels, the first panel having a second edge opposite the first edge, the second panel having a second edge opposite the first edge, the second edges of the first and second panels engaging the at least two side panels to maintain the card holder in the open position.

3. The card holder of claim 1, wherein the pockets are transparent.

4. The card holder of claim 1, wherein the first plurality of pockets includes sixteen pockets arranged in four columns of four pockets and the second plurality of pockets includes sixteen pockets arranged in four columns of four pockets.

5. The card holder of claim 1, further comprising:

a plurality of first flexible material strips attached in an overlapping fashion to the first side of the first rigid panel at a plurality of spaced apart locations that extend orthogonal to a direction in which the first flexible material strips extend in order to form the first plurality of pockets; and a plurality of second flexible material strips attached in an overlapping fashion to the first side of the second rigid panel at a plurality of spaced apart locations that extend orthogonal to a direction in which the first flexible material strips extend in order to form the second plurality of pockets.

6. The card holder of claim 1, further comprising:

a first rigid member;

a second rigid member; and a flexible material encasing the first rigid member and the second rigid member so that the encased first rigid member forms the first rigid panel, the encased second rigid member forms the second rigid panel, and an encased space between edges of the first and second rigid members forms the flexible hinge.

7. A card holder comprising:

a first rigid panel having a first side, a second side and a first edge;

a second rigid panel having a first side, a second side and a first edge;

a flexible hinge connecting the first edge of the second rigid panel to the first edge of the first rigid panel such that the first side of the first rigid panel faces the first side of the second rigid panel when the card holder is in a closed position and the second side of the first rigid panel faces the second side of the second rigid panel when the card holder is in an open position;

a first plurality of pockets attached to the first side of the first rigid panel, each of the first plurality of pockets having an opening directed toward the first edge of the first rigid panel; and a second plurality of pockets attached to the first side of the second rigid panel, each of the second plurality of pockets having an opening directed toward the first edge of the second rigid panel;

wherein the pockets are transparent.

8. The card holder of claim 7, wherein the first plurality of pockets includes sixteen pockets arranged in four columns of four pockets and the second plurality of pockets includes sixteen pockets arranged in four columns of four pockets.

9. The card holder of claim 7, further comprising:

a plurality of first transparent flexible material strips attached in an overlapping fashion to the first side of the first rigid panel at a plurality of spaced apart locations that extend orthogonal to a direction in which the first flexible material strips extend in order to form the first plurality of pockets; and a plurality of second transparent flexible material strips attached in an overlapping fashion to the first side of the second rigid panel at a plurality of spaced apart locations that extend orthogonal to a direction in which the first flexible material strips extend in order to form the second plurality of pockets.

10. The card holder of claim 7, further comprising:

a first rigid member;

a second rigid member; and a flexible material encasing the first rigid member and the second rigid member so that the encased first rigid member forms the first rigid panel, the encased second rigid member forms the second rigid panel, and an encased space between edges of the first and second rigid members forms the flexible hinge.

11. A card holder in combination with a box lid having at least two side panels, the card holder comprising:

a first rigid panel having a first side, a second side and a first edge;

a second rigid panel having a first side, a second side and a first edge;

a flexible hinge connecting the first edge of the second rigid panel to the first edge of the first rigid panel such that the first side of the first rigid panel faces the first side of the second rigid panel when the card holder is in a closed position and the second side of the first rigid panel faces the second side of the second rigid panel when the card holder is in an open position;

a first plurality of pockets attached to the first side of the first rigid panel; and a second plurality of pockets attached to the first side of the second rigid panel;

the first and second rigid panels being, attached to each other by only the flexible hinge, and including no additional supporting structure to maintain the card holder in the open position, the card holder being incapable of maintaining itself in the open position;

the first rigid panel of the card holder having a second edge opposite the first edge, the second rigid panel of the card holder having a second edge opposite the first edge, the second edges of the first and second rigid panels engaging the at least two side panels of the box lid to maintain the card holder in the open position.

12. The combination of claim 11, wherein the pockets of the card holder are transparent.

13. The combination of claim 11, wherein each pocket of the first plurality of pockets has an opening directed toward the first edge of the first rigid panel; and each pocket of the second plurality of pockets has an opening directed toward the first edge of the second rigid panel.

14. The combination of claim 11, wherein the first plurality of pockets includes sixteen pockets arranged in four columns of four pockets and the second plurality of pockets includes sixteen pockets arranged in four columns of four pockets.

15. The combination of claim 11, wherein the card holder further comprises:

a plurality of first flexible material strips attached in an overlapping fashion to the first side of the first rigid panel at a plurality of spaced apart locations that extend orthogonal to a direction in which the first flexible material strips extend in order to form the first plurality of pockets; and a plurality of second flexible material strips attached in an overlapping fashion to the first side of the second rigid panel at a plurality of spaced apart locations that extend orthogonal to a direction in which the first flexible material strips extend in order to form the second plurality of pockets.

16. The combination of claim 11, wherein the card holder further comprises:

a first rigid member;

a second rigid member; and a flexible material encasing the first rigid member and the second rigid member so that the encased first rigid member forms the first rigid panel, the encased second rigid member forms the second rigid panel, and an encased space between edges of the first and second rigid members forms the flexible hinge.

17. A card holder comprising:

a first rigid panel having a first side, a second side and a first edge;

a second rigid panel having a first side, a second side and a first edge;

a flexible hinge connecting the first edge of the second rigid panel to the first edge of the first rigid panel such that the first side of the first rigid panel faces the first side of the second rigid panel when the card holder is in a closed position and the second side of the first rigid panel faces the second side of the second rigid panel when the card holder is in an open position;

a plurality of first flexible material strips attached in an overlapping fashion to the first side of the first rigid panel at a plurality of spaced apart locations that extend orthogonal to a direction in which the first flexible material strips extend in order to form a first plurality of pockets; and a plurality of second flexible material strips attached in an overlapping fashion to the first side of the second rigid panel at a plurality of spaced apart locations that extend orthogonal to a direction in which the first flexible material strips extend in order to form a second plurality of pockets;

the first and second rigid panels being attached to each other by only the flexible hinge, and including no additional supporting structure to maintain the card holder in the open position, the card holder being incapable of maintaining itself in the open position.

18. The card holder of claim 17, wherein the pockets are transparent.

19. The card holder of claim 17, wherein the first plurality of pockets includes sixteen pockets arranged in four columns of four pockets and the second plurality of pockets includes sixteen pockets arranged in four columns of four pockets.

20. The card holder of claim 17, further comprising:

a first rigid member;

a second rigid member; and a flexible material encasing the first rigid member and the second rigid member so that the encased first rigid member forms the first rigid panel, the encased second rigid member forms the second rigid panel, and an encased space between edges of the first and second rigid members forms the flexible hinge.

* * * * *